US008408167B2

(12) United States Patent
Ko

(10) Patent No.: US 8,408,167 B2
(45) Date of Patent: Apr. 2, 2013

(54) PISTON OF ENGINE

(75) Inventor: Gabseok Ko, Anyang-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 687 days.

(21) Appl. No.: 12/336,355

(22) Filed: Dec. 16, 2008

(65) Prior Publication Data

US 2009/0301426 A1 Dec. 10, 2009

(30) Foreign Application Priority Data

Jun. 5, 2008 (KR) ..... 10-2008-0052923

(51) Int. Cl.
*F01P 5/10* (2006.01)

(52) U.S. Cl. ..... 123/41.36; 123/41.44; 123/193.6; 123/184.22

(58) Field of Classification Search ..... 123/41.44, 123/41.35, 41.34, 48 B, 193.6, 181 R, 182, 123/186

See application file for complete search history.

(56) References Cited

U.S. PATENT DOCUMENTS

| | | | | | |
|---|---|---|---|---|---|
| 4,206,726 | A * | 6/1980 | Johnson et al. | ..... | 123/41.35 |
| 4,286,505 | A * | 9/1981 | Amdall | ..... | 92/186 |
| 4,901,679 | A * | 2/1990 | Hodgkins et al. | ..... | 123/41.35 |
| 5,186,137 | A * | 2/1993 | Salzmann | ..... | 123/192.2 |
| 5,285,752 | A * | 2/1994 | Reed et al. | ..... | 123/61 R |
| 6,032,619 | A * | 3/2000 | Zhu et al. | ..... | 123/41.35 |
| 2005/0263110 | A1 * | 12/2005 | Yasui | ..... | 123/41.72 |
| 2006/0207548 | A1 * | 9/2006 | Saito et al. | ..... | 123/276 |

FOREIGN PATENT DOCUMENTS

| | | |
|---|---|---|
| JP | 2005214037 | 8/2005 |
| JP | 2006152879 | 6/2006 |
| JP | 2006-200410 A | 8/2006 |
| JP | 2007132302 | 5/2007 |

* cited by examiner

*Primary Examiner* — Noah Kamen
*Assistant Examiner* — Long T Tran
(74) *Attorney, Agent, or Firm* — Morgan, Lewis & Bockius LLP

(57) ABSTRACT

A piston cooling apparatus of an engine may include a combustion chamber formed between a piston disposed in a cylinder block and a cylinder head disposed on the cylinder block, wherein a surface area-enlarging portion is formed inside the piston on bottom surface of a crown of the piston.

11 Claims, 4 Drawing Sheets

PISTON OF ENGINE

CROSS-REFERENCE TO RELATED APPLICATIONS

The present application claims priority to Korean Patent Application Number 10-2008-0052923 filed Jun. 5, 2008, the entire contents of which application is incorporated herein for all purposes by this reference.

BACKGROUND OF THE INVENTION

1. Field of the Invention

The present invention relates to a piston of an engine, particularly a piston of an engine that reduces damage, noise, vibration due to abnormal combustion by reducing the temperature of a combustion chamber through smooth cooling.

2. Description of Related Art

As shown in FIG. 1, a combustion chamber 4 of an engine is formed by the upper surface of a piston 2 disposed in a cylinder block 1 and a cylinder head 3 disposed on a gasket on the upper surface of the cylinder block 1 (a recessed upper surface of the combustion that covers the upper portion of a cylinder bore is formed on the lower surface of the cylinder head 3).

Piston 2 is connected to a crankshaft through a connecting rod 5 to be able to convert up-down motion of piston 2 into rotary motion.

FIG. 2A is a plan view of piston 2, FIG. 2B is a front view, FIG. 2C is a cross-sectional view taken along the line A-A in FIG. 2A, FIG. 2D is a bottom view of piston 2 (seen in direction A in FIG. 2A), and FIG. 2E is a plan view of the bottom of the crown of the piston.

As shown in the figures, valve pockets (2*c*: pocket for an exhaust valve, 2*d*: pocket for an intake valve) that prevent collision of valves and the piston at the maximum cycle of the intake/exhaust valves are formed on the upper surface of piston 2, that is, the upper surface of crown 2*a*. The lower surface of crown 2*a* in the piston is recessed upward (except for pin bosses 2*b*) and pin bosses 2*b* are formed to face each other and has pin holes 2*b*' formed through the pin bosses 2*b*, such that a small end of the connecting rod is connected with a piston hole 2*b*' by a piston pin.

On the other hand, in an engine equipped with a turbocharger, when the compression ratio in combustion chamber 4 is excessively increased by excessive supply, abnormal combustion, such as knocking, is caused by rapid mix with excessive air around the top dead center in combustion.

Therefore, the main parts of the engine are damaged by high temperature and pressure due to the abnormal combustion, such as damage to the intake/exhaust valves, breakage and sticking of the piston, and crack in the valve bridge of the cylinder head, which decreases durability of the engine.

Further, there was a problem in that combustion noise is caused by the abnormal combustion when a vehicle starts or changes the speed.

Further, there was a problem in that abnormal vibration is caused in the engine by the abnormal combustion.

In the above cases, combustion process due to abnormal ignition is prevented by delaying spark (ignition) timing or decreasing the temperature in combustion chamber 4. However, when the spark timing is delayed, engine power is reduced, and when a water jacket (cooling water passage) is provided to the cylinder head around the combustion chamber to decrease the temperature in the combustion chamber, the material of the cylinder head should be changed.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide for a piston of an engine that can decrease the temperature in the combustion engine by cooling around the combustion engine without changing the material of the cylinder head, taking a method of decreasing the temperature in the combustion chamber in ways of preventing abnormal combustion.

In an aspect of the present invention, a piston cooling apparatus of an engine may include a combustion chamber formed between a piston disposed in a cylinder block and a cylinder head disposed on the cylinder block, wherein a surface area-enlarging portion is formed inside the piston on bottom surface of a crown of the piston.

The surface area-enlarging portion may be configured to be dented on the bottom surface of the crown.

The surface area-enlarging portion may include at least a curved portion to drain oil supplied thereto.

The surface area-enlarging portion may be formed perpendicular to a longitudinal axis of a piston pin, at the bottom surface of the crown where an intake valve pocket is formed.

The surface area-enlarging portion may be formed perpendicular to a longitudinal axis of a piston pin, at the bottom surface of the crown where an exhaust valve pocket is formed.

The surface area-enlarging portion may be formed perpendicular to a longitudinal axis of a piston pin, at the bottom surface of the crown where an intake valve pocket is formed, and may be formed perpendicular to the longitudinal axis of the piston pin, at the bottom surface of the crown where an exhaust valve pocket is formed.

The surface area-enlarging portion may include at least an embossing.

The surface area-enlarging portion may include at least a cooling groove.

The cooling groove may extend from a side on the bottom surface of the crown to between both pin bosses.

The cooling groove may be formed in a dome shape that is long in the perpendicular direction to longitudinal axis of a piston pin.

A cooling fin may be formed between the cooling grooves, the cooling fin and the cooling grooves being formed sequentially.

A piston cooling jet may be disposed to the cylinder block and supply oil to the bottom surface of the crown of the piston to increase cooing efficiency.

The piston cooling jet may be disposed at upper end portion of the crankcase of the cylinder block.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 3:
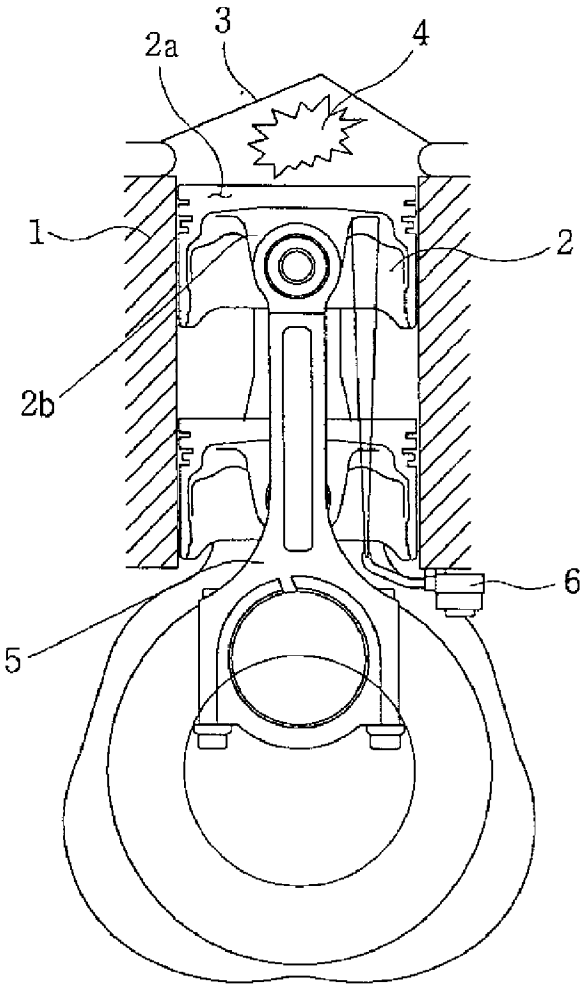
FIG. 3 is a schematic cross-sectional view of an engine achieved by an exemplary embodiment of the present invention.

FIG. 3 is a view illustrating the configuration of an engine equipped with a piston according to various embodiments of the present invention, in which a cylinder block 1, a piston 2, a cylinder head 3, and a connecting rod 5 are simply shown.

As known in the art, piston 2 is disposed in cylinder block 1, connecting rod 5 is connected to piston 2, and cylinder head 3 is disposed on the upper portion of cylinder block 1, such that a combustion chamber 4 is formed with the upper surface of piston 2.

In various exemplary embodiments of the present invention, a method of decreasing the temperature of piston 2 under combustion chamber 4 is used as explained hereinafter.

In various embodiments of the present invention, cylinder block 1 is equipped with a piston cooling jet 6 to increase the cooling effect of piston 2.

Piston cooling jet 6, a device jetting engine oil onto the inner side of piston 2, that is, the bottom of a crown 2*a*, is mounted on the upper end of a crankcase of cylinder block 1.

However, the piston cooling jet can be mounted anywhere as long as it does not interfere with the operation of a large end of connecting rod 5 and the crankshaft connected to the large end, and is not limited to a specific position.

However, the end of a jet nozzle of piston cooling jet 6 should face the bottom of crown 2*a* of piston 2 to be able to jet engine oil to the bottom of the crown of the piston.

Figure 1:
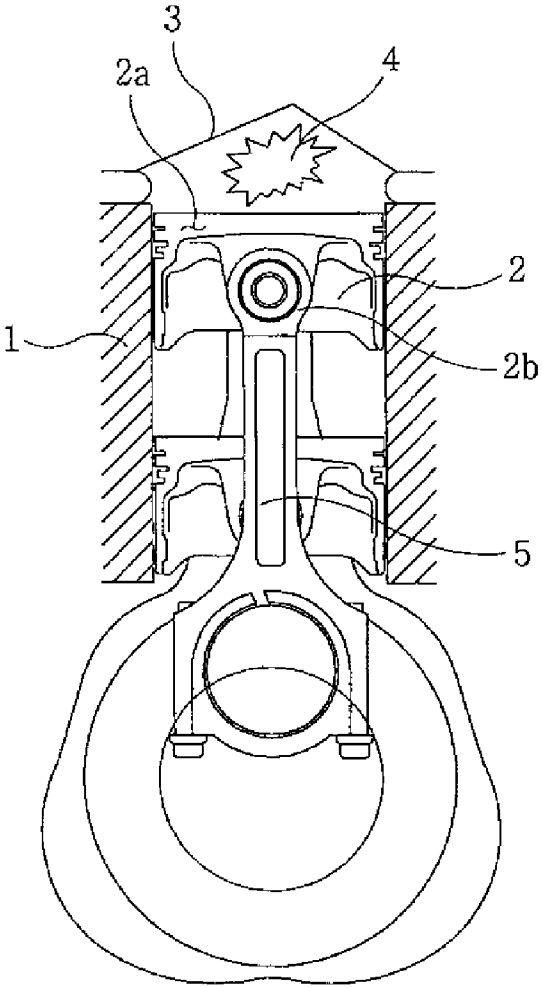
FIG. 1 is a schematic cross-sectional view of an engine.
Figure 2:
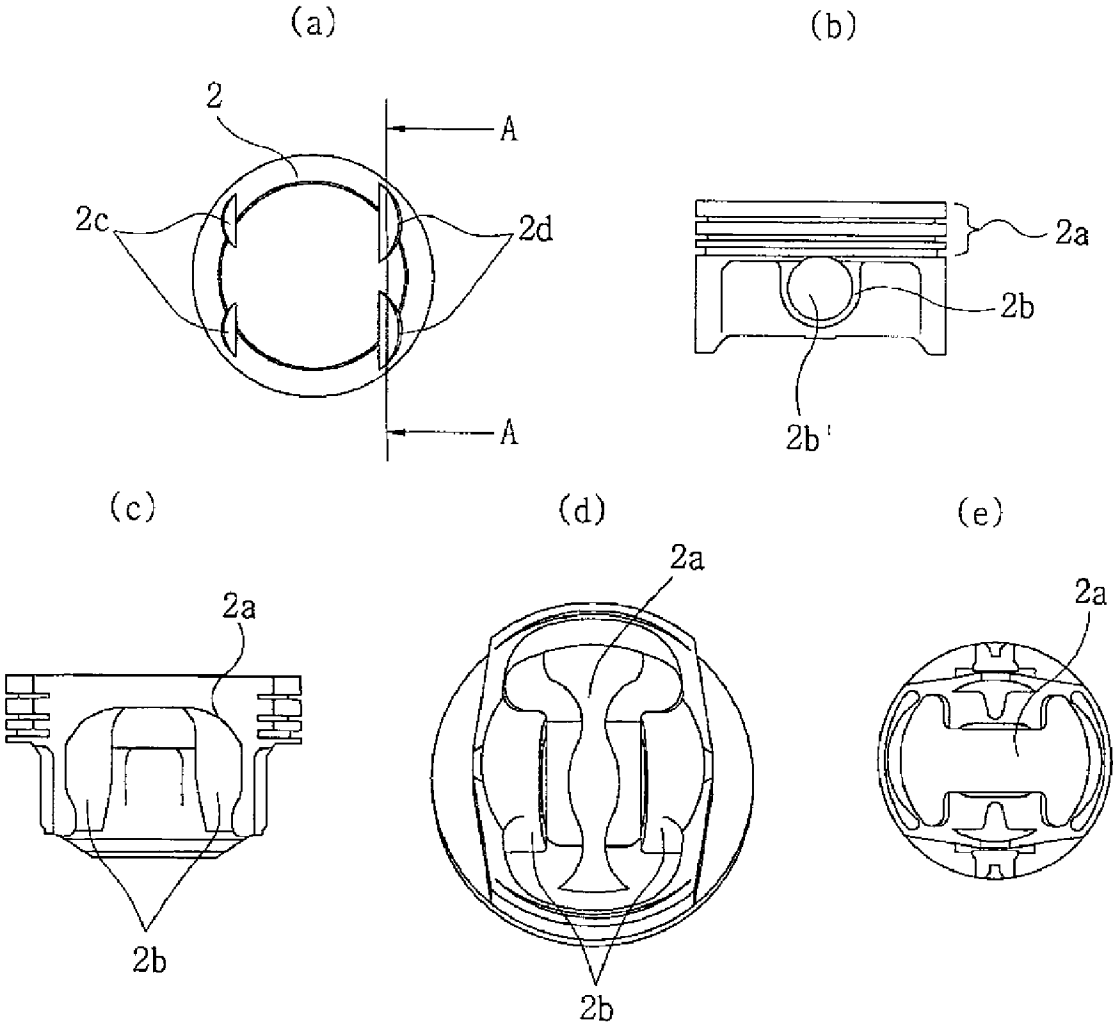
FIG. 2A is a plan view of a piston in the related art.
FIG. 2B is a front view of the piston.
FIG. 2C is a cross-sectional view taken along the line A-A in FIG. 2A.
FIG. 2D is a bottom view of the piston.
FIG. 2E is a plan view of the bottom of a crown of the piston.

In various embodiments of the present invention, the end of the jet nozzle may face a portion where the intake valve is disposed, that is, the bottom of the crown 2*a* where an intake valve pocket 2*d* is disposed (see FIG. 2A).

However, in other embodiments of the present invention, the piston cooling jet 6 may be disposed at the opposite side of cylinder block 1 such that the jet nozzle faces the bottom of the crown 2*a* where an exhaust valve pocket 2*c* of piston 2 is disposed.

Meanwhile, an engine oil intake portion (pipe) of piston cooling jet 6 extends under an oil surface of an oil fan attached to the lower portion of the crankcase to suck oil in the oil fan. Alternatively, the engine oil intake portion (pipe) may extend inside an oil gallery formed in cylinder block 1 that transfers the oil in the oil fan to the cylinder head to suck oil flowing inside the oil gallery. This is a natural configuration for receiving the engine oil and not shown in detail.

Figure 4:
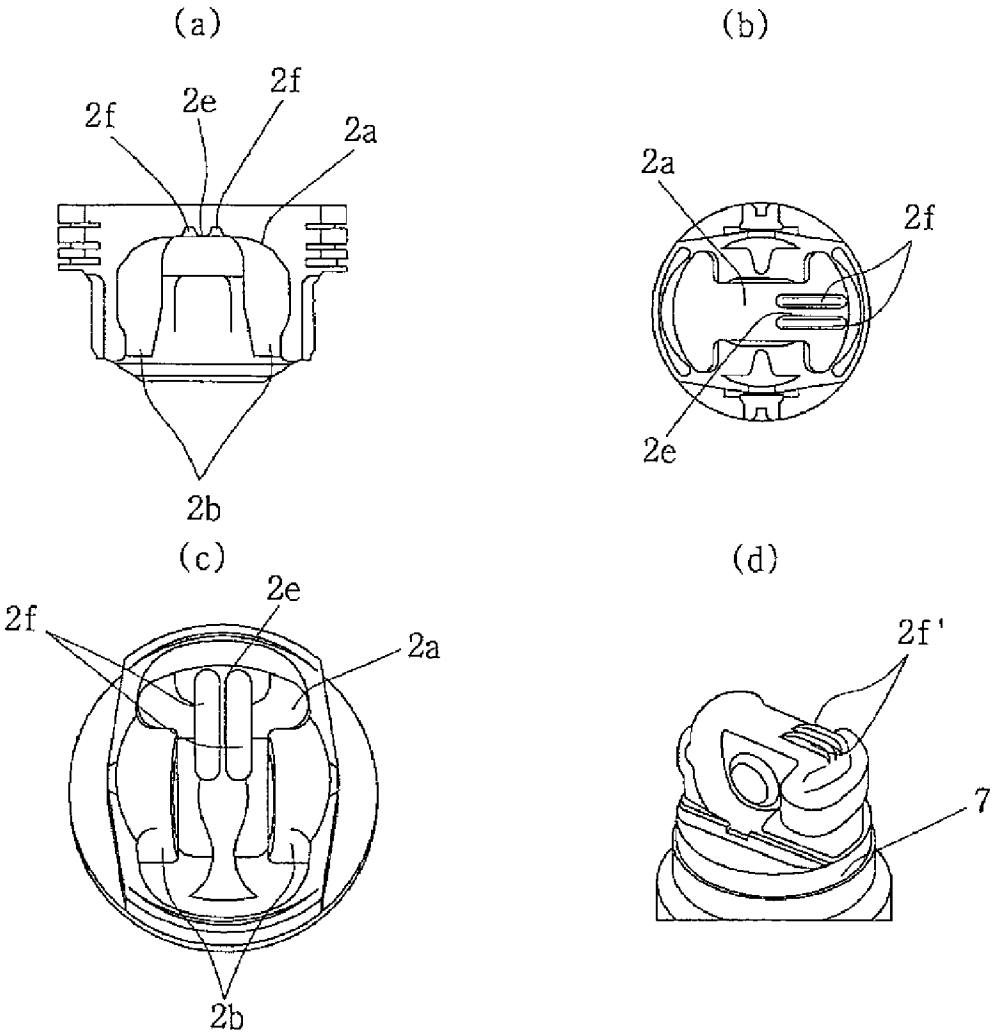
FIG. 4A is a cross-sectional view of a portion where an intake valve pocket of a piston is formed according to an exemplary embodiment of the present invention.
FIG. 4B is a plan view of the bottom of the crown of the piston shown in FIG. 4A.
FIG. 4C is a bottom view of the piston.
FIG. 4D is a perspective view an under crown mold for forming the bottom shape of the piston crown.

On the other hand, FIG. 4A is a view corresponding to FIG. 2C (compare before/after improved), FIG. 4B is a view corresponding to FIG. 2E, and FIG. 4C is a view corresponding to FIG. 2D.

As shown in the figures, a surface area-enlarging portion is formed on the bottom of crown 2*a* of piston 2. In various embodiments of the present invention, at least one end portion of the surface area-enlarging portion may include curved portion having a predetermined curvature so that the oil supplied to the surface area-enlarging portion can drained easily along the curved portion thereof.

The surface area-enlarging portion can be formed in various shapes and is formed of cooling grooves 2*f* in various embodiments of the present invention.

That is, a pair of cooling grooves 2*f* is formed at a predetermined distance on the bottom of crown 2*a* of the piston and the portion between both cooling grooves 2*f* functions as a cooling fin 2*e* protruding relative to cooling grooves 2*f*.

Further, cooling grooves 2*f* and cooling fin 2*e* are formed perpendicular to the axis of a piston pin that is inserted into a hole of a pin boss 2*b*.

FIG. 4B is a view of the bottom of the crown seen from above, such that cooling grooves are seen protruding relative to cooling fin 2*e*.

FIG. 4C is a bottom view of the piston, that the crown seen from the crown (the same phase as in FIG. 4C and rotated at 90° from FIG. 4B). It can be seen that cooling groove 2*f* is formed in a dome shape, which is long and recessed toward the upper surface of the piston, and the ends of cooling groove 2*f* are rounded.

As shown in FIG. 4D illustrating an under crown mold, cooling fin 2*e* and cooling grooves 2*f* are formed by protrusions 2*f'* configured to form cooling grooves 2*f*. The protrusions 2*f'* are formed apart at a predetermined distance on the upper surface of an under crown mold 7 that is used for shaping the inside of piston 2. Cooling fin 2*e* is formed by the space between protrusions 2*f*.

The surface area-enlarging portion can form a regular or irregular pattern by a plurality of protrusions 2*f* and thus the number and the shapes of the grooves and protrusions are not limited. That is, on the bottom of the crown, the protrusions and grooves can be formed in various ways as described above, such as that cooling fins each having a regular rectangular cross section may be formed at regular intervals, or semicircular protrusions may be formed at regular intervals, or prominences and depressions each having a triangular or semicircular cross section are repeatedly formed. In further other embodiments of the present invention, the cooling grooves may be formed of embossing.

Meanwhile, the surface area-enlarging portion may be formed where the engine oil is jetted from piston cooling jet 6, for an interactive rise with piston cooling jet 6 (cooling the piston).

In this configuration, the engine oil is uniformly applied to the entire enlarged surface area (for example, in an above illustrated embodiment, the surface area enlarged by cooling grooves 2*f* and cooling fin 2*e*), such that cooling by the engine oil is made throughout the enlarged area, thereby more actively cooling the crown of the piston.

Therefore, in the above embodiment, cooling fin 2*e* and cooling grooves 2*f* are formed at the (intake-sided) portion, where intake valve pocket 2*d* is formed, on the bottom of crown 2*a* from the center axis of the piston.

Further, cooling fin 2*e* and cooling grooves 2*f* are formed horizontally on the bottom of crown 2*a*.

Further, cooling fin 2*e* and cooling grooves 2*f* extend from a side on crown 2*a* to between both pin bosses 2*b*.

Therefore, the engine oil jetted from piston cooling jet 6 is applied onto cooling fin 2*e* and cooling grooves 2*f*, such that cooing can be made in larger area than when they are not formed.

Since cooling is more actively made in the surface area-enlarging portion on the bottom of the crown as described above, heat is actively transferred from the upper surface of crown 2*a*, that is, from the upper surface of piston 2 to the bottom of the crown, such that the temperature of combustion chamber 4 (in more detail, temperature of the mixture in the combustion chamber) which is in contact with the upper surface of the piston is decreased, thereby preventing abnormal combustion due to abnormal ignition at a certain position.

In particular, cooling is actively made at the intake portion, where abnormal combustion occurs, which is effective in preventing abnormal combustion due to excessive supply of air.

Since abnormal combustion is prevented by cooling the piston to decreasing the temperature of the combustion chamber as described above, the problems due to high temperature and pressure by the abnormal combustion are reduced, such as damage to the intake/exhaust valves, crack in the valve bridge of the cylinder head, and breakage of the crown of the piston.

Further, since there is not abnormal combustion, abnormal combustion noise and abnormal vibration is not generated when the vehicle starts or changes the speed.

Further, according to the various embodiments of the present invention, since the temperature in the combustion chamber is decreased by cooling the piston, the cylinder head does not need a water jacket, such that it is not needed to change the material of the cylinder head.

For convenience in explanation and accurate definition in the appended claims, the terms "upper" and "lower" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A piston cooling apparatus of an engine comprising a combustion chamber formed between a piston disposed in a cylinder block and a cylinder head disposed on the cylinder block, wherein a surface area-enlarging portion is formed inside the piston on bottom surface of a crown of the piston;

wherein the surface area-enlarging portion includes at least two cooling grooves and a cooling fin on bottom surface of the surface area-enlarging portion;

wherein the cooling fin is formed between the cooling grooves, the cooling fin and the cooling grooves being formed sequentially; and wherein a piston cooling jet is disposed on the cylinder block and supplies oil directly to the cooling grooves to increase cooling efficiency.

2. The piston cooling apparatus of an engine as defined in claim 1, wherein the surface area-enlarging portion is configured to be dented on the bottom surface of the crown.

3. The piston cooling apparatus of an engine as defined in claim 1, wherein the surface area-enlarging portion includes at least a curved portion to drain oil supplied thereto.

4. The piston cooling apparatus of an engine as defined in claim 1, wherein the surface area-enlarging portion is formed perpendicular to a longitudinal axis of a piston pin, at the bottom surface of the crown where an intake valve pocket is formed.

5. The piston cooling apparatus of an engine as defined in claim 1, wherein the surface area-enlarging portion is formed perpendicular to a longitudinal axis of a piston pin, at the bottom surface of the crown where an exhaust valve pocket is formed.

6. The piston cooling apparatus of an engine as defined in claim 1, wherein the surface area-enlarging portion is formed perpendicular to a longitudinal axis of a piston pin, at the bottom surface of the crown where an intake valve pocket is formed, and is formed perpendicular to the longitudinal axis of the piston pin, at the bottom surface of the crown where an exhaust valve pocket is formed.

7. The piston cooling apparatus of an engine as defined in claim 1, wherein the cooling groove extends from a side on the bottom surface of the crown to between both pin bosses.

8. The piston cooling apparatus of an engine as defined in claim 1, wherein the cooling groove is formed in a dome shape that is long in the perpendicular direction to longitudinal axis of a piston pin.

9. The piston cooling apparatus of an engine as defined in claim 1, wherein the piston cooling jet is disposed at upper end portion of a crankcase of the cylinder block.

10. A piston comprising the piston cooling apparatus of an engine as defined in claim 1.

11. A passenger vehicle comprising the piston cooling apparatus of an engine as defined in claim 1.

* * * * *